US007106202B2

(12) United States Patent
Dickinson

(10) Patent No.: US 7,106,202 B2
(45) Date of Patent: Sep. 12, 2006

(54) SHIPPING CONTAINER ALONG WITH SHIPPING METHOD EMPLOYING THE SAME

(76) Inventor: Kent H. Dickinson, 6228 Water's Edge Dr., Covington, GA (US) 30014

( * ) Notice: Subject to any disclaimer, the term of this patent is extended or adjusted under 35 U.S.C. 154(b) by 356 days.

(21) Appl. No.: 10/170,013

(22) Filed: Jun. 10, 2002

(65) Prior Publication Data

US 2003/0052786 A1 Mar. 20, 2003

Related U.S. Application Data

(63) Continuation-in-part of application No. 09/956,478, filed on Sep. 18, 2001, now Pat. No. 6,737,974.

(51) Int. Cl.
*G08B 13/14* (2006.01)

(52) U.S. Cl. ..... 340/572.8; 340/825.49; 53/472; 206/459.5; 206/521; 206/522; 206/523; 383/61.3; 383/109

(58) Field of Classification Search ..... 340/572.8, 340/693.5; 705/28; 342/357.07; 410/119, 410/125; 53/469, 472; 206/522, 594; 399/12; 383/3, 109, 113
See application file for complete search history.

(56) References Cited

U.S. PATENT DOCUMENTS

| | | | | |
|---|---|---|---|---|
| 3,750,167 | A | 7/1973 | Gehman et al. | 342/44 |
| 4,044,867 | A | 8/1977 | Fisher | 190/107 |
| 4,107,861 | A | 8/1978 | Johnson | 40/654.01 |
| 4,136,788 | A | 1/1979 | Robbins | 410/119 |
| 4,465,188 | A | 8/1984 | Soroka et al. | 206/522 |
| 4,494,592 | A | 1/1985 | Bonner | 383/5 |
| 4,569,082 | A | 2/1986 | Ainsworth et al. | 383/3 |
| 4,573,202 | A * | 2/1986 | Lee | 383/3 |
| 4,793,123 | A * | 12/1988 | Pharo | 53/449 |
| 4,858,755 | A | 8/1989 | Kuivanen | 119/269 |
| 4,949,840 | A * | 8/1990 | Brown | 206/204 |
| 5,038,283 | A | 8/1991 | Caveney | 705/28 |
| 5,059,033 | A | 10/1991 | Branson | 383/13 |
| 5,129,519 | A * | 7/1992 | David et al. | 206/523 |
| 5,217,131 | A | 6/1993 | Andrews | 220/1.5 |
| 5,272,856 | A * | 12/1993 | Pharo | 53/472 |
| 5,323,922 | A | 6/1994 | Lapoint, Jr. et al. | 220/4.28 |
| 5,417,790 | A | 5/1995 | Petrou | 156/249 |
| 5,425,456 | A * | 6/1995 | Erickson | 209/2 |
| 5,450,948 | A * | 9/1995 | Beausoleil et al. | 206/204 |
| 5,487,470 | A * | 1/1996 | Pharo | 206/522 |
| 5,497,140 | A | 3/1996 | Tuttle | 340/10.1 |
| 5,547,075 | A | 8/1996 | Hoogerwoord | 206/204 |
| 5,557,096 | A | 9/1996 | Watanabe et al. | 235/492 |
| 5,621,647 | A | 4/1997 | Kraemer et al. | 700/145 |

(Continued)

*Primary Examiner*—Benjamin C. Lee
(74) *Attorney, Agent, or Firm*—Timothy J. Martin; Michael R. Henson; John W. Carpenter

(57) ABSTRACT

A container to receive a parcel for shipment to an intended recipient comprises a pouch having a pouch interior and a mouth, a closure movable between open and closed positions, and a protective insert structure removably disposed in the pouch interior to substantially envelop the parcel and reduce risk of damage to it during shipment. In another embodiment, the container comprises a container body, a closure and a air bladder disposed in the container body for receiving and substantially enveloping the items to reduce damage thereto during shipment. Methodologies are also provided for shipping a parcel from a shipper located at an origin address location to an intended recipient located at a destination address location.

31 Claims, 10 Drawing Sheets

U.S. PATENT DOCUMENTS 5,628,858 A 5/1997 Petrou ..... 156/249
5,681,115 A 10/1997 Diederich et al. ..... 340/572.8
5,762,197 A * 6/1998 Farison ..... 206/522
5,844,485 A 12/1998 Ryan, Jr. ..... 340/572.1
5,845,806 A 12/1998 Parchman ..... 220/739
5,880,675 A 3/1999 Trautner ..... 383/64
5,957,583 A 9/1999 DeClements, Jr. et al. ..... 383/3
6,128,549 A 10/2000 Swartz et al. ..... 700/225
6,139,188 A * 10/2000 Marzano ..... 383/110
6,148,291 A * 11/2000 Radican ..... 705/28
6,161,959 A 12/2000 Abraham ..... 383/97
6,176,613 B1 1/2001 Chen ..... 383/3
6,177,860 B1 1/2001 Cromer et al. ..... 340/10.1
6,182,826 B1 2/2001 Slepian ..... 206/315.4
6,204,764 B1 3/2001 Maloney ..... 340/568.1
6,224,258 B1 5/2001 Dodson ..... 383/9
6,231,233 B1 5/2001 Orce ..... 383/38
6,259,367 B1 7/2001 Klein ..... 340/572.1
6,281,795 B1 8/2001 Smith et al. ..... 340/572.1
6,297,727 B1 10/2001 Nelson, Jr. ..... 340/10.1
6,334,537 B1 1/2002 Tepper ..... 206/522
6,335,685 B1 * 1/2002 Schrott et al. ..... 340/572.1
6,398,109 B1 6/2002 Ohki ..... 235/384
6,429,810 B1 * 8/2002 De Roche ..... 342/357.07
6,520,544 B1 * 2/2003 Mitchell et al. ..... 283/70
6,532,346 B1 * 3/2003 Gallivan ..... 399/12
6,536,189 B1 * 3/2003 Murray ..... 53/440
6,537,003 B1 * 3/2003 Rostoker ..... 410/119
6,557,758 B1 * 5/2003 Monico ..... 235/380

* cited by examiner

SHIPPING CONTAINER ALONG WITH SHIPPING METHOD EMPLOYING THE SAME

RELATED APPLICATION

The present application is a continuation-in-part of my application Ser. No. 09/956,478 entitled "Shipping Container And System Along With Shipping Method Employing The Same", filed Sep. 18, 2001, now U.S. Pat. No. 6,737, 974.

FIELD OF THE INVENTION

The present invention is broadly directed to containers and systems that may be used for shipping parcels in a parcel carrier industry. In addition, the present invention concerns methods used by those carriers to transport parcels between senders and recipients. The present invention especially concerns containers and methods that integrate advantageous and cost saving techniques wherein the shipping pouches/containers can be conveniently tracked during transport and reused.

BACKGROUND OF THE INVENTION

A fundamental need of commerce based societies is the transportation of goods from one location to another. The development of various postal systems, first on the national and then on an international basis, established an organized system wherein a carrier, for a price, would convey a parcel from a shipper to a recipient. The service provided by such carriers resulted in increasing demand and expansion of their served customer base. In addition to the governmentally sponsored postal services, private carriers have been organized to transport a wide variety of parcels for paying customers. Such companies include those known as United Parcel Service, Federal Express, DHL, Airborne and Emory, to name a few. The proliferation of such companies demonstrates the increasing need for their services.

In addition to the ordinary demands on the parcel carrier industry, the expansion of internet commerce already has and is expected to continue to place increasing demands on the need to ship small parcels from a merchant to a customer. The role of the parcel carrier is becoming increasingly integral to the success or failure of consumers' on-line experience and business in general. Shippers know the importance of having a dependable carrier who ultimately provides dependable service to the end-use customer.

The shipping trend in recent times has been toward smaller parcels, some of which are breakable but the majority of which are considered non-fragile or non-breakable. Indeed, as much as 65% to 70% of the entire parcel market in the United States may be classified as non-fragile, meaning that the actual products being shipped are resistant to damage if handled with any degree of care. However, traditional shipping techniques as far as packaging the parcels are not varied greatly between fragile and non-fragile items with the sometimes exception of the degree of cushioning in the material used for more fragile items.

For the past 40–50 years, shippers have been conditioned to excessively package parcel shipments because there have been few alternatives. Such excessive packaging leads to increased packing costs. This packaging cost results from two factors. First, the cost of packaging materials is not trivial. Typically, parcels are packed inside a one-time use only container, such as a paperboard carton, with the interior of the container filled with cushioning materials, such as styrofoam "peanuts", shredded paper or other paper based filler, to name a few. Second, there is a substantial time investment in packaging that results from the need to carefully pack and seal the paperboard carton and prepare the shipping documents for the same.

In addition to the problem of cost, packing waste is one of the leading contributors to landfill waste today and is a frustration for both the shipper and the recipient. This results from the need to inventory and dispose of these non-reusable materials. As internet commerce and mobile inventory management processes continue to grow, waste from shipped parcels can only be expected to worsen. This is especially true since a vast majority of parcels are excessively over-packaged with the actual product accounting for only about 25% of the available space inside each paperboard box. This is despite the fact that a majority of products could have been shipped without any packaging materials.

Such wasted space also reduces the volume shipping capacity of carriers, be it air transport or land based transport, such as trucks. The shipping of the packaging waste exhibits both direct costs as well as indirect costs in increased fuel consumption, wear and tear on airports, highways, etc. as well as environmental impact. By reducing the amount of waste materials, such indirect costs could be reduced.

While carriers profess to be interested in understanding the hardships on shippers, the only response to these hardships seems to have been in logistics planning. Little effort has been made to avoid unnecessary effort because the carriers would be required to change the service they offer. Further, the presence of several dominant players in the carrier industry have virtually dictated the packaging techniques that have been used for the last few decades, with these rules being those that have resulted in the costs discussed above.

Therefore, while current handling methods were acceptable in the past, there has been an increasing need felt for many years to develop better parcel handling techniques. The environmental and financial factors have been suggesting for many years the need for better solutions to providing carrier services. Indeed, even political factors are changing with governmental agencies listing the activities of box packaging and taping as an activity subject for repetitive motion injury. Accordingly, there is an ever increasing need for solutions to reduce or eliminate the liabilities of current parcel packaging and carriage.

There is also an increasing need to implement added security measures for the transportation of parcels between shippers and recipients. This is particularly true given recent events involving tainted mail which is intended to injure or kill innocent and unwary recipients. While it is important that mail service of parcels not be delayed in reaching their intended recipients, it is equally if not more important that for individuals, corporations or other entities to verify the shipper's identity so at least a preliminary determination can be made as to whether the parcel is of questionable origin. At the same time, it is also desirable to meet this security need without frustrating the carrier's ability deliver the parcels is a manner which is both time efficient and economically feasible.

SUMMARY OF THE INVENTION

It is an object of the present invention to provide a new and useful container for shipping parcels between locations.

Another object of the present invention to provide a reusable container that avoids the requirement of excessive parcel cushioning materials.

A further object of the present invention is to provide a simple, reusable container that reduces the time necessary to containerize parcels as well as one that reduces the risk of repetitive motion injury.

It is still a further object of the present invention to provide a reusable containers that protect parcels during shipment.

Yet another object of the present invention is to provide a new and useful method for shipping parcels from shippers to recipients that incorporates the containers noted above.

It is still a further object of the present invention is to provide a method for shipping parcels that can increases the ease of sorting and tracking such parcels.

It is yet another object of the present invention to provide containers and a method for shipping parcels that offers added security and reliability so that a recipient can verify the identity of an expected or know sender.

According to one aspect of the invention, a container is provided which is adapted to receive a parcel for shipment to an intended recipient. Broadly, the container comprises a pouch having a pouch interior and a mouth communicating with the interior, a closure movable between open and closed positions, and a protective insert structure removably disposed in the interior of the pouch. The protective insert structure has an associated interior adapted to substantially envelop the parcel to reduce risk of damage thereto during shipment.

The protective insert structure may include one or both of an inflatable bladder and a puncture resistant lining so that the container can be modular in construction. Where both are employed, the puncture resistant lining is preferably disposed in the pouch interior in facing relationship to the pouch, with the inflatable bladder disposed interiorly of the puncture resistant lining.

A removable label is also provided and includes a strip constructed of a selected strip material along with an area to receive information corresponding to an address of the intended recipient. The label also has a layer of selected adhesive. The container has a label panel secured to the container body with the label panel including an exposed surface portion formed of a material to which the selective adhesive will adhere sufficiently to retain the label on the container body during shipment, yet from which the label may be forcefully removed without tearing the strip of material.

The container's pouch is preferably flexible and includes first and second body panels joined about a majority of their periphery to define a sealed edge with an unjoined portion defining the mouth. The pouch's closure may be a zipper having a pull-tab. A first grommet may be disposed on the first body panel and a second grommet may be disposed on the second body panel, with each of the first and second grommets being located proximately to the pull-tab of the zipper when the zipper is closed. This defines a locking structure for the pouch. A locking member is then provided and is operative to engage the first and second grommets and the pull-tab thereby to secure the zipper in the closed position. This locking member may be a cable tie that extends through the grommets and engages the pull-tab such as extending through the eye thereof. The first and second body panels of the pouch may be formed with a multi-layered construction and a radio frequency (RF) signal transmitter may be supported within this flexible pouch, such as in a pocket formed thereon.

As stated above, the container may include one or both of a puncture resistant lining or an air bladder, such as one which is inflatable. The puncture resistant lining is preferably formed from a stiff yet flexible material such as semi-rigid plastic or Kevlar. Preferably also, the puncture resistant lining is releasably secured to the flexible pouch through the use of one or more fastening structures such as cooperative hook and loop fastening elements disposed, respectively, on the lining and the pouch.

Where an inflatable air bladder is employed, it is preferably provided with an inflation valve having a valve stem adapted to receive air from an air source. Preferably also, the air bladder is formed as a flexible bag having first and second bag panels joined about a portion of its perimeter to define a sealed edge with an unjoined portion defining a mouth communicating with an interior of the bladder. Each of the bag panels is formed as a multi-layered plastic construction to include an array of inflatable cells which communicate with the inflation valve.

Another aspect of the present invention relates to a method of shipping a parcel from shipper located at an origin address location to an intended recipient located at a destination address location. This method broadly comprises proving a shipping container for the parcel, which shipping container includes an associated signal transmitter having a unique identification code embedded therein. The unique identification code is retrieved from the signal transmitter and correlated with data corresponding to the destination address of the intended recipient. Either before or after this, the parcel is packed into the shipping container to create a shipping package and thereafter delivered to the destination address of the intended recipient. Retrieval of the signal transmitter's unique identification code is preferably accomplished by scanning the signal transmitter with a scanning device. During transit of the shipping package to the intended recipient's destination address, it can be periodically tracked with a second scanning device operative to retrieve the unique identification code of the signal transmitter. Further, once the shipping package has been delivered to the destination address, the container and its associate signal transmitter may be cleared for reuse by disassociating the signal transmitter's unique identification code from the destination address.

A second exemplary embodiment of the methodology of the present invention may be particularly utilized by a user having a service agreement with a parcel courier for the shipment of parcels between shipping locations and destination locations. This methodology, accordingly, involves the preliminary steps of establishing a computerized user account with the courier service and accessing the user accounts along a communication interface by logging on to a server computer system associated with the courier service via a remotely located user computer system. As such, the shipping user interfaces with a stored computer program on the user's computer system to arrange for the shipment of parcels. Also according to this methodology, a first scanning device may be used to communicate a signal transmitter's unique identification code to the user's computer system via an appropriate communications interface established therebetween, and the user can provide input data to his/her computer system via an input device, with the software program processing this input data and the signal transmitter's unique identification code to create the correlation therebetween prior to the courier picking up the shipping package. Once the shipping package has been picked up, the courier can periodically track the location of the package during transit to the destination address by scanning the shipping packages signal transmitter with a second scanning device to retrieve the unique identification code therefrom. This second methodology could, of course, additionally incorporate other methodology steps discussed above with reference to the first exemplary embodiment of the methodology of the present invention.

BRIEF DESCRIPTION OF THE DRAWINGS

FIG. 5(*b*) is a partial perspective view in cross-section of a corner region of an alternative construction for a pouch which may be used as a component with the modular container of the present invention;

DETAILED DESCRIPTION OF THE EXEMPLARY EMBODIMENTS

According to the present invention, then, a container is provided for receiving a parcel for shipment to an intended recipient. The container may have a modular construction with one or more protective components so that it can be used for shipping non-breakable, non-fragile and even many fragile parcels. Further, the container may additionally incorporate a radio frequency (RF) transmission component which contains imbedded shipping information and provides tracking capabilities which a parcel is en route between a shipper and a recipient. The container, whether in its exemplary embodiment that is primarily discussed herein and shown in the figures or in another modular form, can form part of a system that includes a plurality of containers along with cartons or "totes" that may be palletized between support and cover pallets during transportation. Moreover, the present invention includes a shipping method that incorporates the modular container forms described herein. Accordingly, the present invention provides an extension to the teachings of my co-pending U.S. patent application Ser. No. Ser. No. 09/956,478, filed Sep. 18, 2001, the disclosure of which is incorporated herein by reference.

Figure 1:
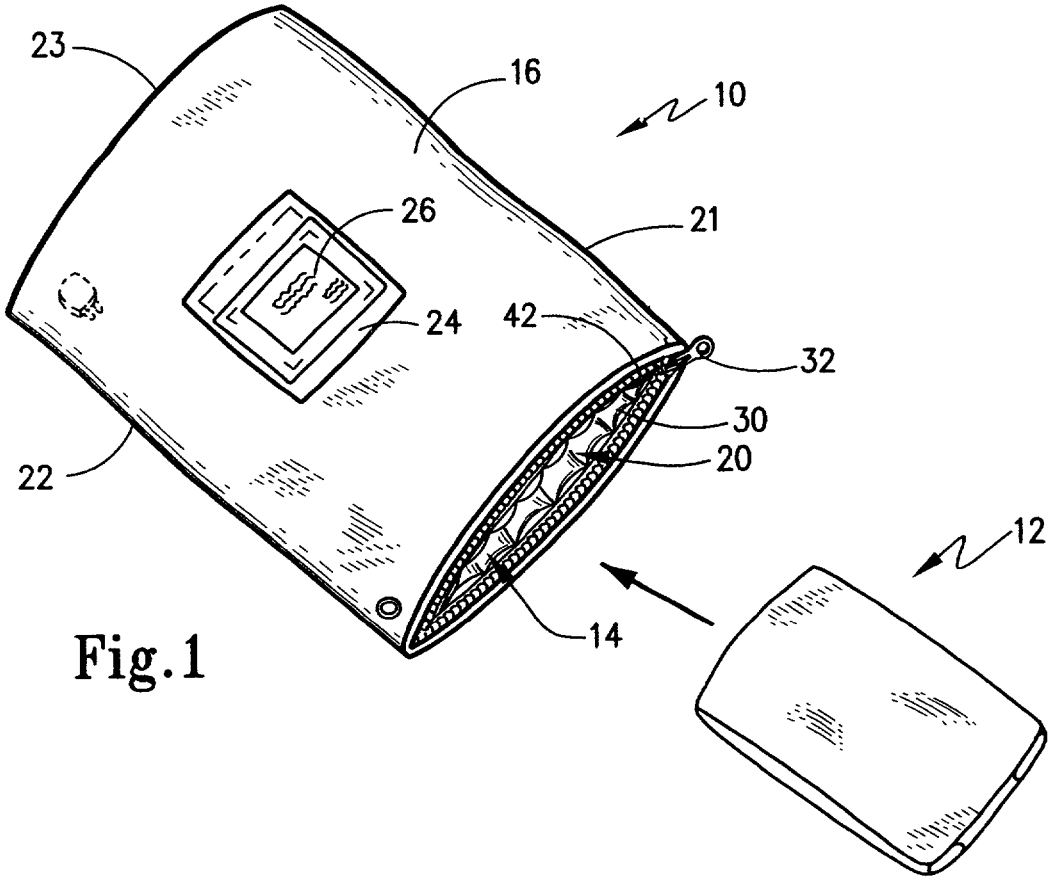
FIG. 1 is a perspective view showing a representative parcel being inserted into a container that is constructed according to an exemplary embodiment of the present invention, with the container being in an open state.
Figure 2:
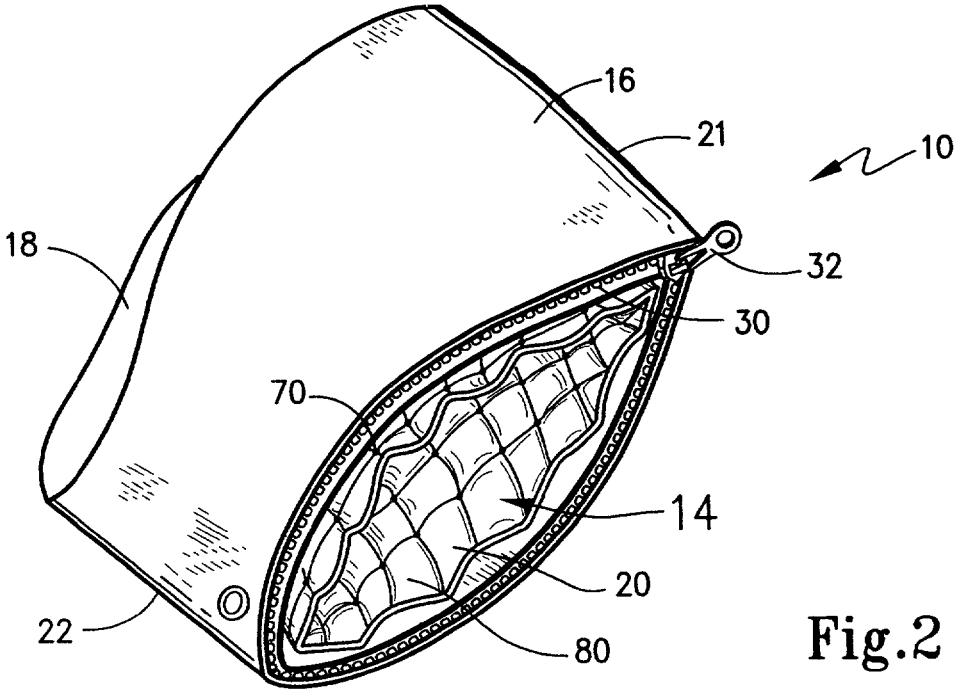
FIG. 2 is a partial perspective view of the container shown in FIG. 1 in its open state.
Figure 3:
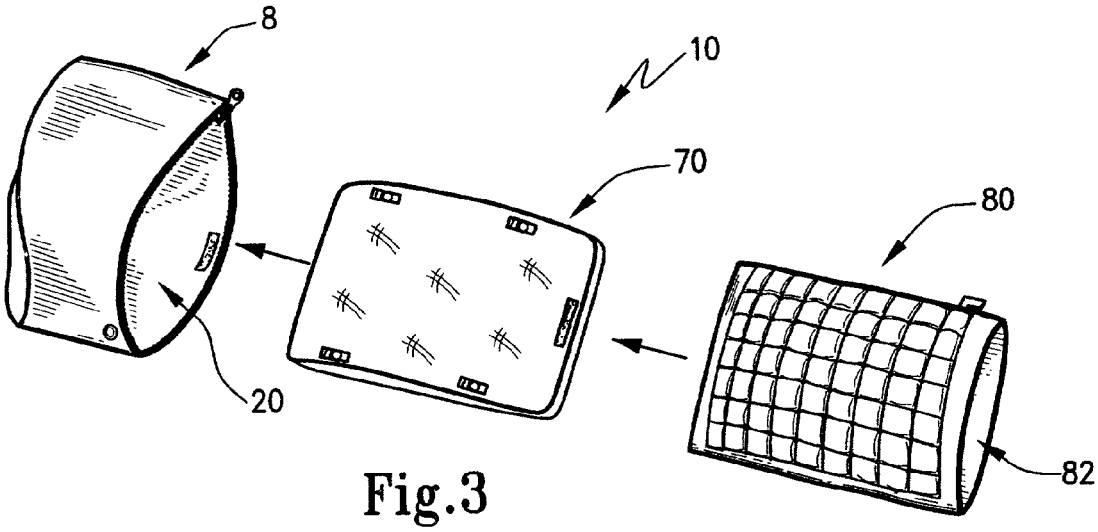
FIG. 3 is an exploded perspective view showing a protective insert structure ensemble which may be used as components for the container shown in FIGS. 1 and 2.
Figure 4:
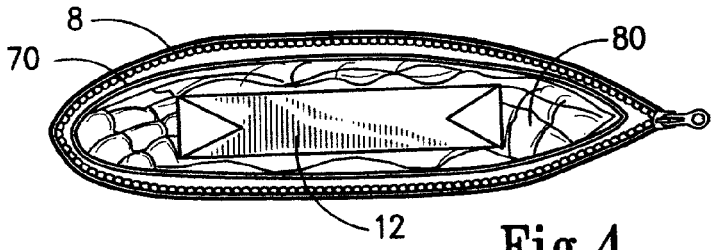
FIG. 4 is a front end view of the container of FIGS. 1 and 2 once the parcel has been received therein.

With reference initially to FIGS. 1–3, a modular container 10 is shown that is adapted to receive a parcel 12 in the container's interior 14. As perhaps best illustrated with specific reference to FIG. 3, the modular container according to the exemplary embodiment of the present invention incorporates a protective ensemble to reduce the risk of damage to the parcel 12 during shipment. The protective insert ensemble may include both a puncture resistant lining 70 and an inflatable bladder 80 which are each sized and adapted to be removably inserted into the interior of a pouch 8 to substantially envelop the parcel to provide protective layers for a fragile item. Preferred constructions for the puncture resistant lining 70 and the inflatable bladder 80 will be discussed more thoroughly below. However, it can be appreciated from FIGS. 3 and 4, for example, that puncture resistant lining 70 is sized and adapted for insertion into the open mouth 20 of pouch 8 and inflatable bladder 80 is sized and adapted for insertion interiorly of puncture resistant lining 70. Parcel 12 is then insertable into the open mouth 82 of bladder 80, after which the bladder 80 can be inflated to an appropriate level so that it conforms to the shape of the parcel 12 as shown best in FIG. 4. This modular construction for container 10, thus, provides a cushioned environment for the parcel 12 by virtue of inflatable bladder 80, as well as an added protective layer provided by lining 70 which prevents puncturing of both the parcel 12 and its surrounding bladder 80 during shipment.

Pouch 8 of container 10 includes a front pouch panel 16 and a back pouch panel 18 which are rectangular in shape and are joined about three edges, 21, 22 and 23 which are located at the perimeter thereof. As discussed more thoroughly below with reference to FIGS. 16 and 17, pouch 8 may also included an imbedded radio frequency (RF) transmitter 120 which can be downloaded with appropriate shipping information and which provides the capability to remotely track the parcel while it is en route between the shipper and recipient. Panels 16 and 18 are open along a portion of the perimeter to define a mouth 20 through which the puncture-resistant lining 70 and the inflatable bladder 80 may be inserted, after which parcel 12 may be inserted, thus defining a received parcel. Front panel 16 supports a label panel 24, such as placard card, that is affixed to container's pouch 8 in any convenient manner, such as by sewing, adhesive, etc. A shipping label 26 may then be removably secured to label panel 24, as described more thoroughly below. If desired, panels 16 and 18 of pouch 8 can be have printed indicia thereon, such as company logos, names, designs, and the like, so that the container becomes readily identifiable. Also, a zipper 30 is provided and includes a pull-tab 32 shown in an open position so that mouth 20 is open. Zipper 30 is preferably a No. 10 type luggage pull zipper which is available from a variety of companies such as YKK America.

Figure 5A:
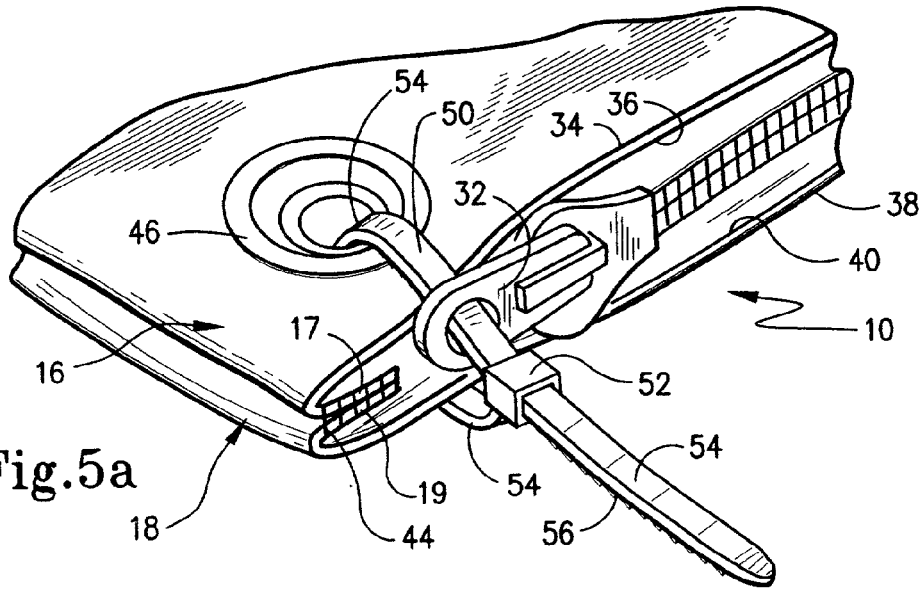
FIG. 5(*a*) is a perspective view of the locking structure according to the exemplary embodiment of the present invention with the container shown in the closed state.
Figure 5B:
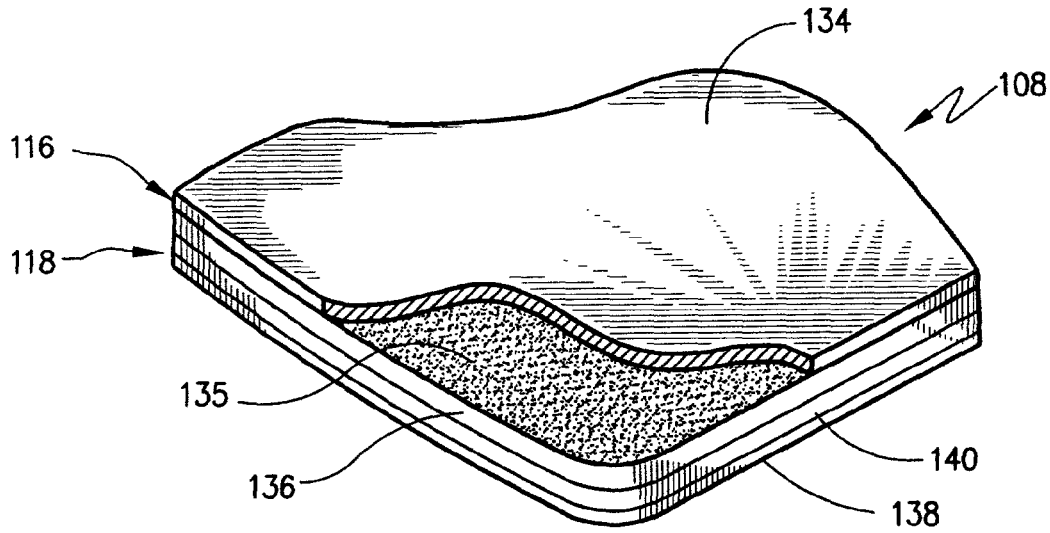

With reference to FIG. 5, the perimeter edges of pouch 8, such as edge 22, is formed by sewing margins 17 and 19 of panels 16 and 18 together, as is known in the art. Furthermore, it may be seen that front panel is formed out of fabric layers 34 and 36, while back panel 18 is formed by a pair of fabric layers 38 and 40. In this embodiment, each of panels 16 and 18 is flexible. Outer fabric layers 34 and 38, as well as inner fabric layers 36 and 40 may be formed of any suitable material, but it should be formed out of a sufficiently durable material so that container 10 may be reused many times. For example, each of the fabric layers 34, 36, 38 and 40 may be formed of a heavy gauged cotton cloth or canvas material, but other suitable materials can be substituted as would be within the ability of the ordinarily skilled artisan. Accordingly, differing fabrics each offering a high degree of wearability, such as a 2-ply, 3-ply or foam-backed fabric, maybe employed. More particularly, the fabric can be a wearable poly-blend cloth that will facilitate reuse while also allowing for cleaning in an industrial washing machine, if desired. Even still, a heavy grade denier, such as 750, 1000 or even a "ballistic-nylon", can be employed. Although more costly, such a denier fabric material will provide for a greater number of uses. Accordingly, the fabric of choice will depend on the intended use but can be any appropriate material without restriction.

FIG. 5(*b*) shows an alternative construction for a pouch 108 which may be used in the container of the present invention. Pouch 108 also includes a pair of panels 116 and 118 which may be attached at their margins by sewing or other appropriate means. Upper panel 116, however, in this version is formed of an outer protective material 134, such as 30 mils rigid composite plastic, laminated to a 1/32" foam composite layer 136 via an appropriate adhesive 135. Similarly, lower panel 118 is formed by a protective layer 138 laminated to a foam composite material 140. By constructing pouch 108 in this manner, the pouch itself provides both cushioning and puncture resistance during use.

In any event, it may be seen with reference to FIG. 5, that container 10 can be placed in a closed state once the parcel has been inserted by manipulating zipper 30 to close mouth 20. When open, pull-tab 32 is thus located at one corner 42 (FIG. 1) of container 10 but, when closed, it is located proximately to a second corner 44 (FIG. 5) of container 10. Front panel 16 is provided with a metal grommet 46 with metal grommet 46 being located proximately to corner 44. Back panel 18 is similarly provided with an associated metal grommet (not shown) that is also located proximately to corner 44 so that the two metal grommets are in opposed relationship to one another. Moreover, these grommets are located proximately to pull-tab 32 when zipper 30 is shut with container 10 being in the closed state.

From the foregoing, it should be appreciated that zipper 30 provides a closure for container 10 that is movable between an open position such that the parcel may be inserted and removed from the interior 14 of container 10 and a closed position so as to retain the parcel in the interior 14 as a received parcel. It should be understood, however, that closures other than zipper 30 are contemplated by this invention. As an example, zipper 30 could be replaced by a tamper-resistant seal akin those typically found on bags which are used to ship pharmaceuticals. Such tamper-resistant seals exhibit a first color to ensure that the container is appropriately sealed, yet exhibit a second color when broken to provide a visual indication that tampering has occurred. Where a tamper-resistant seal is employed, it is contemplated that the container's pouch 8 could still be constructed of an appropriate fabric material as discussed above, or a somewhat more rigid material such as 20 mil rigid plastic.

Regardless of which closure construction is employed, the closure (such as zipper 30) can be retained in the closed position by a locking structure. For the representative structure described above, a portion of this locking structure is provided by the two grommets. In this exemplary embodiment, the locking structure is completed by the use of a cable tie 50 of the type known in the art. Cable tie 50 has a locking head 52 provided with a ratcheting locking mechanism (not shown) with locking head 52 located on an end of an elongated tail 54. Tail 54 is adapted to extend through the openings formed by the grommets, respectively, and through an eye 33 of pull-tab 32. Tail 54 is then inserted through locking head 52 so that ratchet teeth 56 engage the locking structure and locking head 52, as is well known in the art of cable ties. At this point, the closed or "sealed" container 10 cannot be opened without either damaging cable tie 50 or zipper 30 or otherwise compromising the construction of container 10. That is, the sealed container is resistant to any tampering during the ordinary course of shipment of parcel 12. To this end, also, panels 16 and 18 should be opaque such that a person may not readily view the contents of the received parcel 12.

Figure 6A:
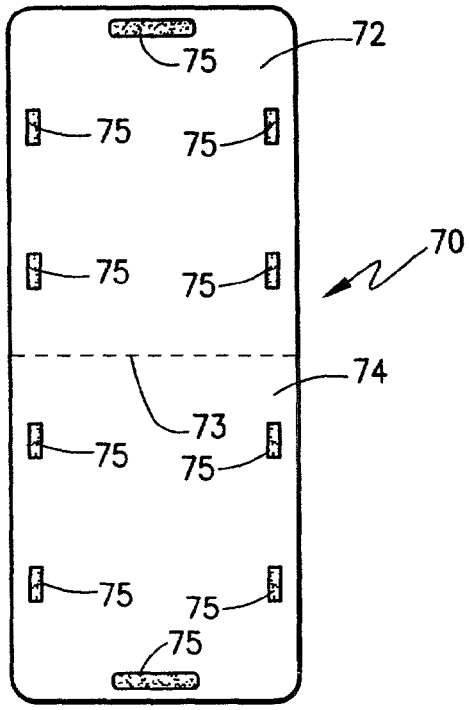
FIGS. 6(*a*) and 6(*b*), respectively, are top and bottom plan views of the container's puncture-resistant lining, and showing the lining in an unfolded condition.
Figure 6B:
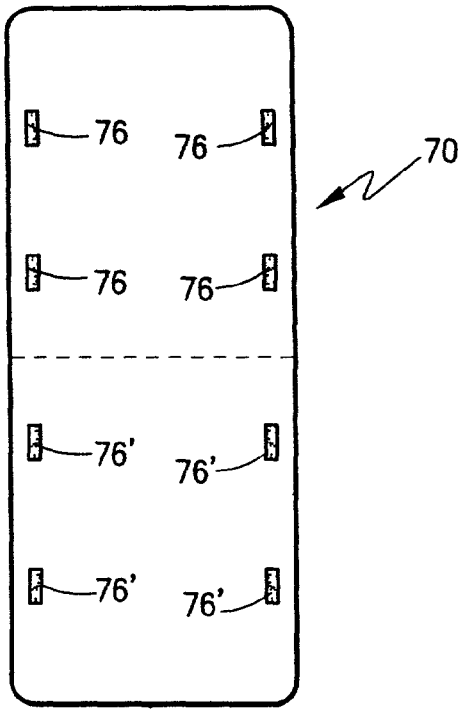
Figure 7:
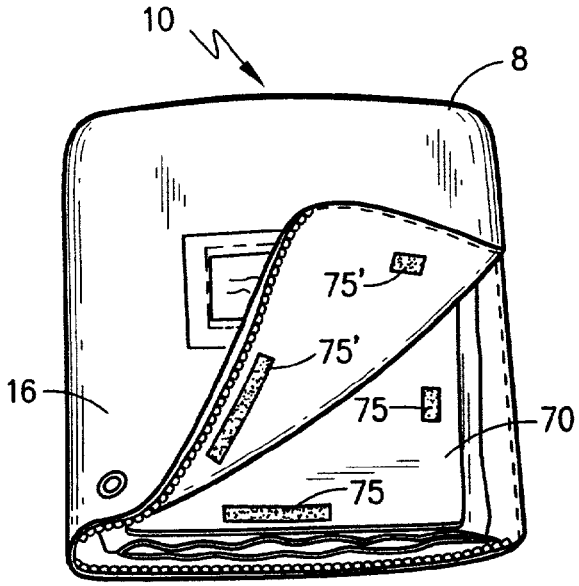
FIG. 7 is a perspective view of the container of FIGS. 1–5 showing a portion of its pouch's panel peeled back to reveal the puncture-resistant lining.

The puncture resistant lining 70 which may be used in connection with modular container 10 is best shown in FIGS. 6(*a*) and 6(*b*). As stated above, puncture resistant lining 70 serves a variety of useful purposes. On the one hand, it can line the inside of flexible pouch 80 and provide protection for parcels that are not shipped inside an air bladder. As such, the liner 70 provide abrasion and shock resistance for products shipped inside the pouch 8. Further, it will provide some protection to the flexible pouch 8 if shipped items are oily or dirty. Furthermore, when the inflatable bladder 80 is used, the lining 70 can provide enhanced puncture resistance to both the inflatable bladder 80 and the shipped parcel. In its preferred form, puncture resistant lining 70 is a elongated rectangular member that is creased about a midline 73 to form a pair of geometrically congruent panel sections 72 and 74 which are oriented in a generally a spaced apart, confronting relationship to one another during shipment. To this end, puncture resistant lining 70 is any appropriate material which is both flexible yet which exhibits the protective capabilities discussed herein. As such, it may be a semi-rigid plastic insert or be formed of Kevlar or other appropriate material.

A plurality of fastening structures are provided on both the puncture resistant lining 70 and the inner panels 36 and 40 of flexible pouch 8 so that the lining 70 can be removably, yet semi-permanently, positioned within the flexible pouch 8. While a variety of fastening structures could be employed for this purpose, in the exemplary form of the protective lining 70, these fastening structures are provided as cooperative hook fastening strips 75 positioned along longitudinal and transverse edge margins of lining 70. Hook fastening strips are appropriately maintained on lining 70 through adhesive, sewing or other appropriate securement means.

Figure 8:
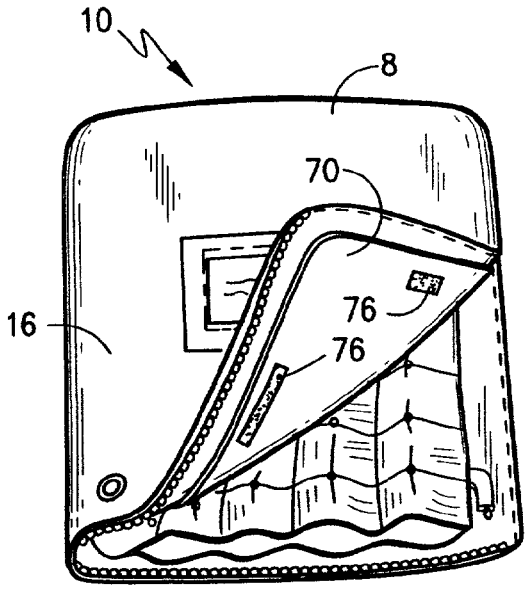
FIG. 8 is a perspective view of the container shown in FIGS. 1–5 and 7, with portions of both the flexible pouch and the puncture-resistant lining peeled back to reveal the inflation bladder.

As shown in FIG. 8, cooperative loop structures 75' are sewn or adhered to the inner fabric layers of the flexible pouch 8, such as inner fabric layer 36 of panel 16, and are positioned to cooperatively engage the outer hook fasteners 75 associated with puncture resistant lining 70. Accordingly, hook structures 75 and loop structures 76 define a first fastening set. In this manner, it is contemplated that puncture resistant lining 70, at most times, can be retained in flexible pouch 8 in a fastened state, as desired. Alternatively, also if desired, a shipper can selectively remove the lining if it is not needed. Indeed, where flexible pouch is formed from an appropriate fabric material, it is envisioned that this material could have a pile construction which permits engage of hook fasteners 75 thereto without requiring separate loop fastening strips to be formed onto pouch 8, thus provided a cost advantage.

In FIGS. 6(*b*) and 8, it may be seen that a second fastening set, defined by of cooperative hook and loop fastening strips 76 and 76' may be adhered, respectively, to the inner surface of lining 70. As such, when lining 70 is creased about crease line 73, panel sections 72 and 74 can also be fastened together to better envelop the parcel during shipment and prevent dislodgement.

Figure 9:
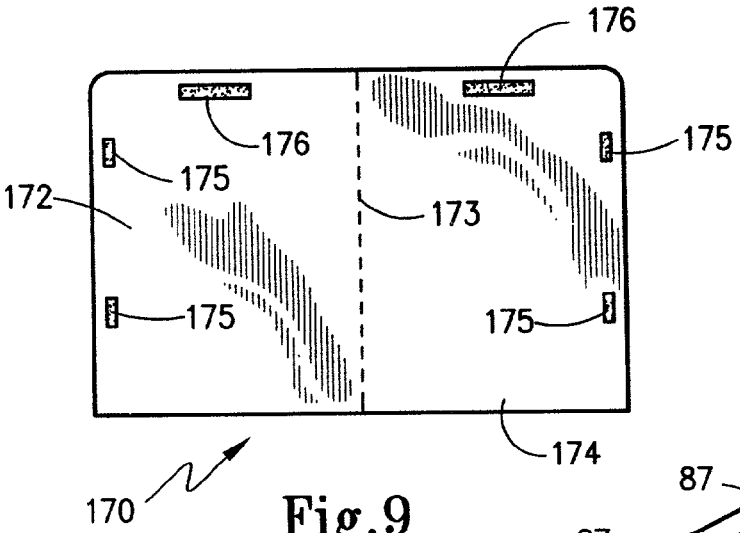
FIG. 9 is a top plan view showing an alternative construction for a puncture-resistant lining according to the present invention.

An alternative construction for the puncture resistant lining is shown in FIG. 9. Here, puncture resistant lining 170 is constructed of the same material but is creased about a different crease line 173 which would necessarily be disposed adjacent to one of the longitudinally extending side edges of the flexible pouch 8 when inserted therein, such as 22 in FIG. 1. As such, this construction provides a cost benefit since fewer cooperative hook and loop fastening strips 175 and 176 need be employed to accomplish securement of lining 70 to flexible pouch 8 and panel sections 172 and 174 to each other. With the above in mind, the ordinarily skilled artisan should readily appreciate that puncture resistant lining 170 can take on a variety of different configurations, as desired, including the ability to releasably secure to the inner panels of the flexible pouch 8 as well as to itself. Moreover, the present invention also contemplates a permanent puncture-resistant lining for a container which, unlike that discussed above and shown in various ones of the figures, is not selectively removable. That is, one or more puncture-resistant lining pieces could be permanently imbedded between the inner an outer layers 34, 36 and 38, 40 associated with flexible pouch 8 so that the modular container always exhibits this protective capability. Accordingly, the various figures only illustrate representative constructions for the puncture-resistant lining, but the invention should not be unduly confined to those shown and described herein.

Figure 10:
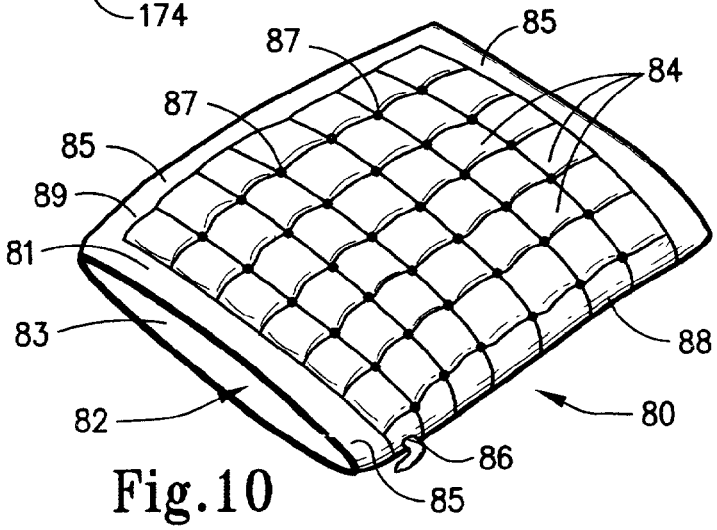
FIG. 10 is a perspective view of the container's inflatable bladder shown in FIG. 3.
Figure 11:
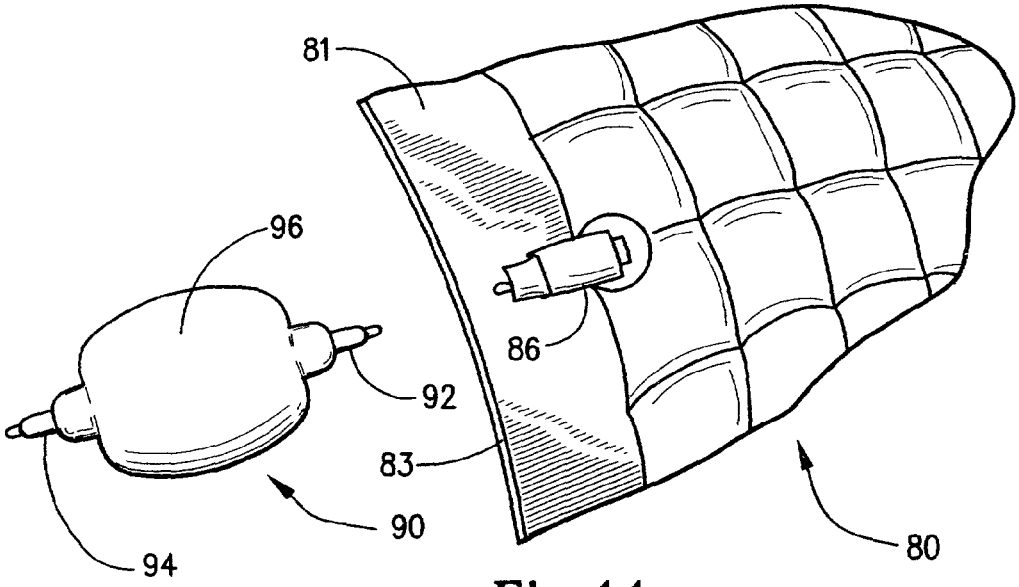
FIG. 11 is an enlarged exploded view showing the inflatable bladder's valve and the squeeze bulb for use therewith.

With reference now to FIG. 10, the inflatable bladder 80 which may also be used in conjunction with the modular container 10 of the present invention is a generally rectangular flexible member formed of a multi-layered construction to include a matrix of cells 82 which communicate with one another to receive air via inflation valve 84. This provides a cushion of air to protect parcels having a higher degree of fragility, or for parcels which the consumer wants to provide additional protection. With reference particularly to FIGS. 10 and 11, inflatable bladder 80 is formed by a pair of flexible panel sections 81 and 83 which are sealed together along their surrounding peripheral edge margin 85, such as through heat sealing or the like, as known in the art. Panels 81 and 83 are also secured by a matrix of spot "welds" to create the array of cells 84 to be inflated. To provide the bladder's open mouth 82, after the flexible panels 81 and 83 are appropriately sealed together, the sealed structure is then folded over upon itself about fold line 88 and appropriately sealed again about transverse seam 89 to create a pouch-like structure. It can be appreciated, then, that the sealing of the peripheral margin 84 of bladder 80 and the spot welding creates a confined volume between the panels 81 and 83 so that the cells 84 can be inflated to a desired level. Accordingly, the "welds" limit the expansion of the bladder, while preferable providing a ¾" to 1½" layer of expansion air protection for shipped product. While the welds are shown in the figures to be even distributed to create the array of cells 84, these welds may be located in a different patterned arrangements, as desired. This would to permit different regions of the bladder to have varying degrees of air cushioning so that the bladder can be tailored to accommodate different parcel configurations or provide varying degrees of air cushioning to different parts of a packaged parcel.

As shown in FIG. 11, inflation may be accomplished by injecting air through the bladder's inflation valve 86, such as through the use of a squeeze bulb 90. Squeeze bulb 90 is similar to that conventionally found on a medical blood pressure cuff, and has a pair of opposed nipples 92 and 94 which are each sized and adapted for attachment to the valve stem 86 of bladder 80 to, correspondingly, inflate and deflate the bladder 80 when the bulbous body 92 of the squeeze bulb 90 is compressed, all as is known in the art. It is contemplated that the squeeze bulb 90 shown in FIG. 11 would be generally used by those shippers sending only a few packages or shipping only occasionally since, relatively speaking, it will take more time to inflate and deflate bladder 80 depending on the size of the parcel being inserted and the volume of air used to fill the bladder. However, advantageous is the fact that squeeze bulb 90 can be appropriately attached to the bladder through any appropriate means or simply inserted into the container so that it forms an integral part of the modular container 10, adding to the convenience of preparing the container for shipment.

Figure 12:
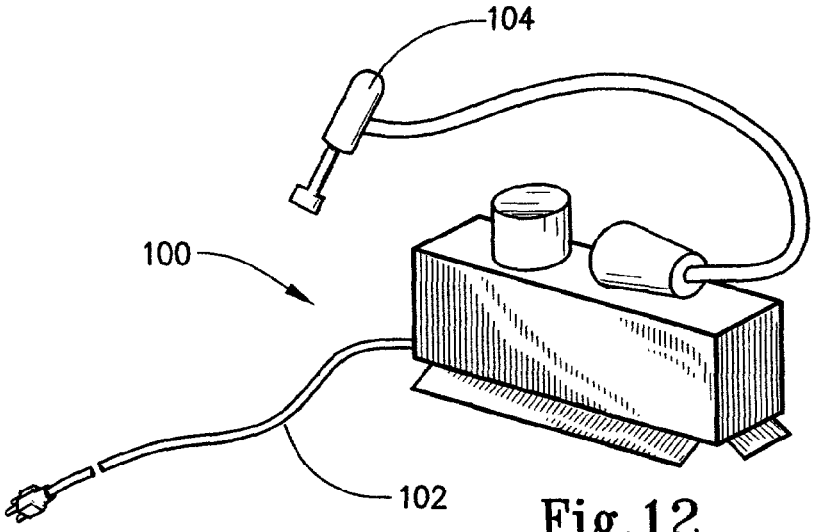
FIG. 12 is an enlarged perspective view illustrating an alternative valve construction for use with the inflatable bladder of the present invention.

Alternatively, as generally represented in FIG. 12, quicker filling and deflation of the bladder can be accomplished through the use of a regulated compressor 100. Compressor 100 includes a power cord 102 and an appropriately designed valve connector 104, such as an NPT valve connector, for attachment to valve 86 of bladder 80. To this end, the compressor of choice is preferably an AC compressor available from the COIDO Corporation of Taipei, Taiwan. Inflation and deflation times with such a regulated compressor will typically be less than ten seconds. Moreover, regulated compressor 100 will prevent over-filling or under-filling of the bladder and might prove to be more convenient for those shippers who send and receive higher volumes of packages. A shipper might, for example, depending upon his or her particular needs, either purchase or lease one or more compressors to expedite and facilitate shipping preparation. Although this would entail a higher up front cost than the squeeze bulb 90 approach, it will result in a cost savings over time given the added efficiency and time savings which would be realized. Still a third means for inflating the bladder could be through the use of a hand pump.

Figure 13:
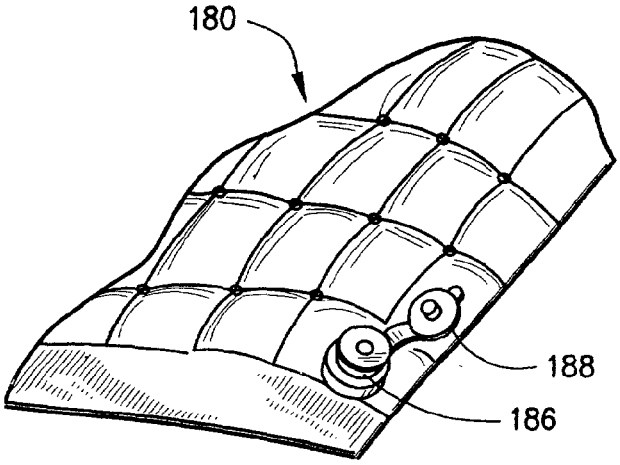
FIG. 13 is a perspective view illustrating a representative regulated compressor which may be used to fill the container's inflatable bladder.

An alternative construction for an inflation/deflation valve for use with the bladder 80 of the present invention is shown in FIG. 13. Here, a valve is shown in the form of a nozzle 186 conventionally used for inflatable rafts, balls and other similar items. Air would thus be blown into bladder 180 via one's mouth and retained therein by closing cap 188. Deflation can then be accomplished by releasing closure cap 188 and, if necessary, compressing the bladder 180 to eject the air.

Figure 14:
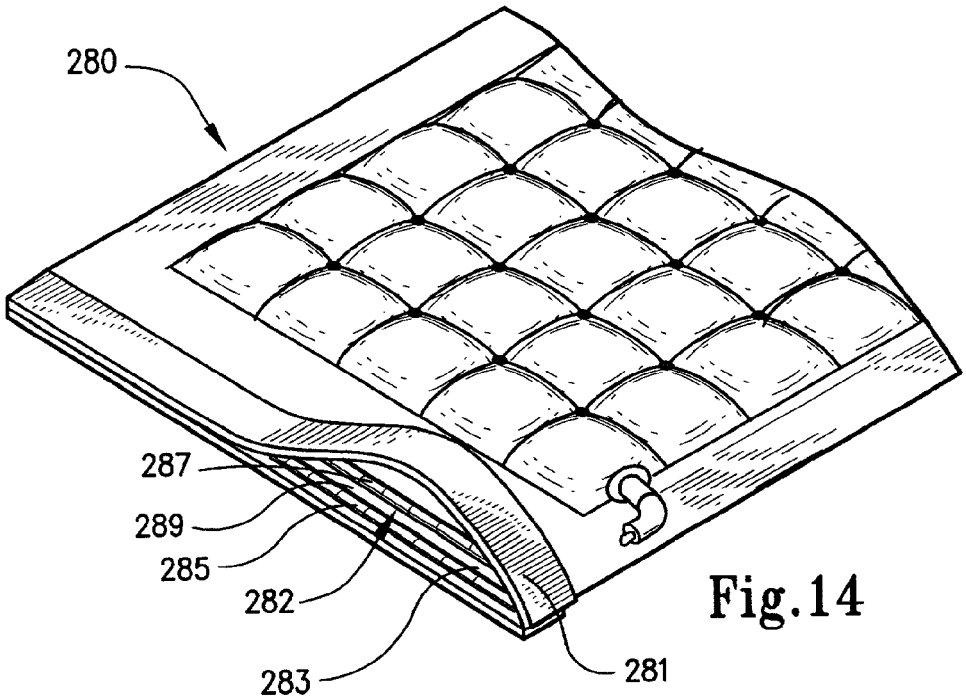
FIG. 14 is a partial perspective view illustrating an alternative construction for an inflatable bladder which may be used as a component to the modular container of the present invention.

Still another alternative construction for an inflatable bladder which may be used in the container of present invention is shown in FIG. 14. Here, inflatable bladder 280 is constructed similarly to inflatable bladder 80 discussed above except that it's mouth region 282 has a somewhat different construction. Here, the bladder's mouth margins 281 and 283 are adapted to releasably seal to one another in a water tight engagment, utilizing sealing means conventionally found on sandwich bags, freezer bags and other types of bag structures where either an air tight seal or a water tight seal is desired. Accordingly, the bag's lower mouth margin 283 includes a pair of transverse ridges 285 and 287 separated by an elongated transverse channel 289. Although not shown, the bag's upper mouth margin 281 correspondingly includes a pair of spaced apart and transversely extending channels separated by a transversely extending rib so that upper mouth margin 281 releasably and sealingly engages lower mouth margin 283, all as is known in the art. It should be appreciated, then, that bladder 280 can be used as part of the modular container construction discussed herein so that it both is inflatable and can receive items for shipment in it's mouth 282. Accordingly, as with other aspects of the present invention, a variety different types of constructions are also contemplated for providing an air cushion as a protective layer for shipped parcels, without restriction to those which are particularly described herein.

Another contemplated use for such a bladder 280 when used in conjunction with the flexible pouch discussed above is that it can serve as both a floatble dry storage device (for storing things such as one's personal items when rafting, canoeing or otherwise), or it can even be used as a pillow while camping by virtue of its inflatability. Indeed, any of the bladder constructions discussed herein may used in conjunction with a variety of flexible pouch constructions, including those described, to create such a pillow structure.

Figure 15:
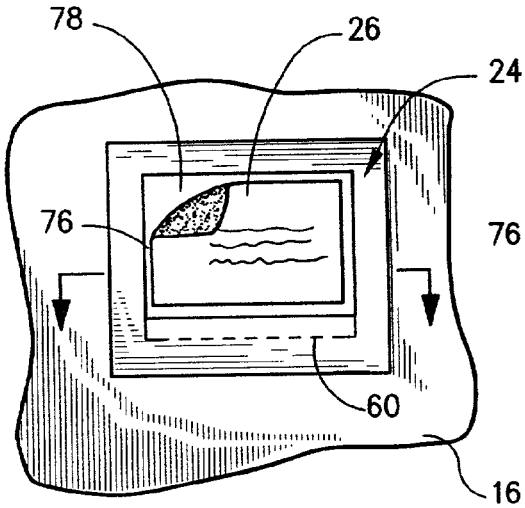
FIG. 15 is a top plan view of the label panel according to the present invention with a diagrammatic representation of a shipping label secured thereto.
Figure 16:
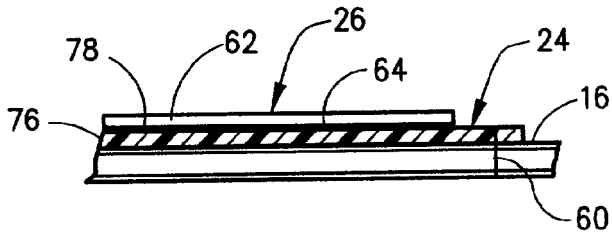
FIG. 16 is a cross-sectional view showing the label panel on a pouch panel with the shipping label secured thereto, as viewed about lines 16—16 in FIG. 15.

Looking now at FIGS. 15 and 16, it may be seen that label panel 24 is affixed to front panel 16, here by stitching 60, although it should be understood that other attachment techniques are known. Label panel 24 is preferably in the form of a semi-rigid plastic placard that provides some flexibility, with a memory to return to its flattened position. This placard 24 is designed sufficiently large enough to receive a label 76 formed as a strip 62 of a selected material such as plastic, that includes a lower layer 64 of a suitable adhesive material that is adapted to adhere to label panel/placard 24. The opposite exposed surface of label 76 is provided with a Teflon coating 78 for receiving a sticky-backed address label 26. Thus, label 76 is permanently placed on the label panel/placard 24, yet it is designed to allow for easy placement and removal, without tearing, of temporary address labels such as address label 26. The Kennedy Group of Cleveland, Ohio distributes such a label which is the subject of U.S. Pat. Nos. 5,417,790 and 5,628,858. Label 26 is adapted to be secured to label panel 24 in a manner so that the adhesive layer 64 will adhere sufficiently to retain label 26 to the container body during shipment, yet from which the label may be forcibly removed without normally tearing strip 62 during removal.

The above construction, thus, provides for enhanced reuse of the container 10 without leaving a sticky residue or torn labels from previous deliveries. Accordingly, it should be appreciated that the release material formed by Teflon coating 78 is selected to interact with adhesive material 64 along with the composition of strip 62 such that label 26 is firmly yet releasably secured to container 10. This allows label 26 to remain on container 10 throughout shipment yet permits it to be removed from label panel 24 so that the container 10 may be reused numerable times.

As also described in my co-pending application Ser. No. 09/956,478 address label 26 can include appropriate areas for receipt of information corresponding to the sender and the intended recipient. In addition, areas can be appropriately provided for bar code information to provide identifiers for the particular package, as well as codes for the sender and recipient, including the recipient's address. As discussed below, however, it is not necessary to provide this information in either handwritten format or bar coded format since the container of the present invention preferably incorporates an imbedded RF signal transmitter, although such information can be provided as a back-up in the event the RF signal transmitter becomes inoperable or otherwise becomes damaged during use.

Figure 17:
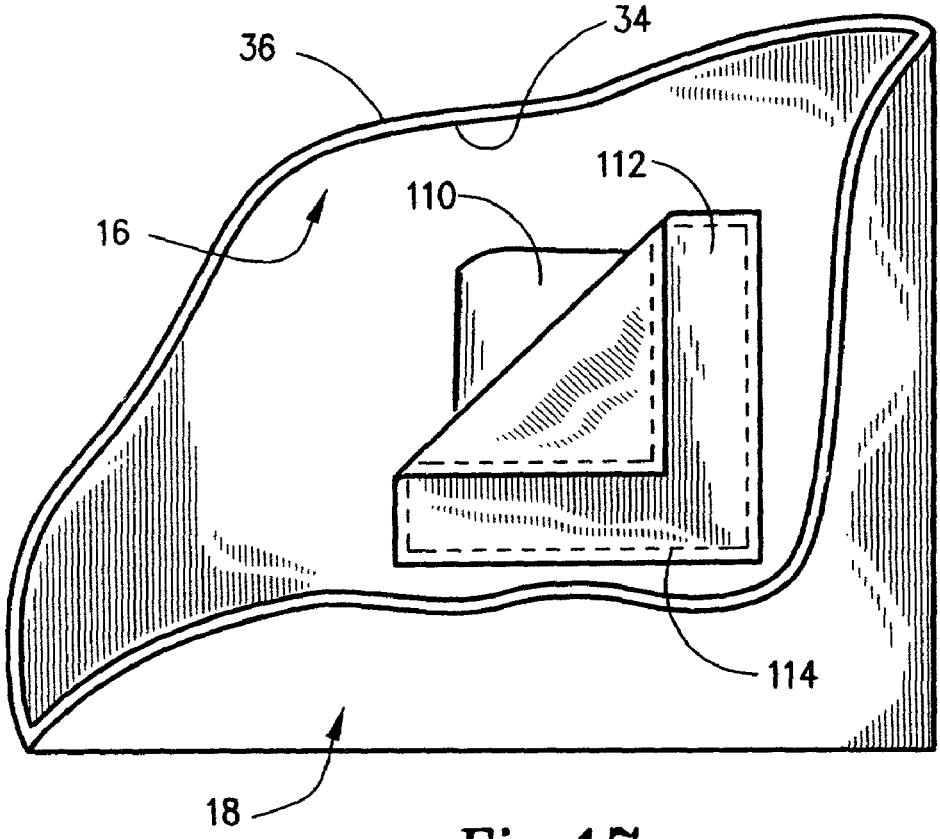
FIG. 17 is a perspective view, partially broken-away, showing the incorporation of an RF transmitter in the container of FIG. 1.
Figure 18:
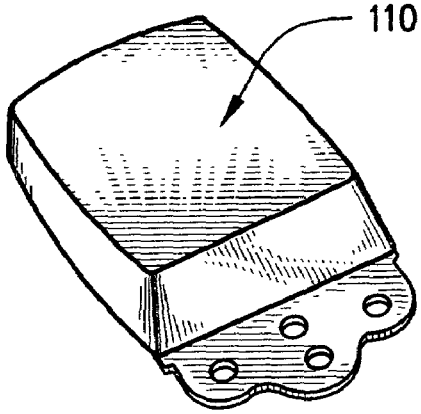
FIG. 18 is a perspective view of a representative RF signal transmitter shown in FIG. 16 which may be incorporated into the container of the present invention.

As noted above, the shipping label which releasably secures to the container's placard may contain indicia, in either printed or bar code format, corresponding to pertinent shipping information such as the sender's origin address, the recipient's address destination, etc. Alternatively, or in conjunction with this, a more permanent identifier may also be provided, as shown in FIGS. 17 and 18. Here, a radio frequency (RF) transmitter 110 is shown contained within a pocket 112 formed on pouch panel 16. Pocket 112 is secured to panel 16 through stitching 114, although other approaches could be used to accomplish embedding RF transmitter 110 within the container of the present invention, such as by placing it between the panel layers 34 and 36, or by releasably securing a pocket appropriately to the container's pouch, such as through Velcro or the like. Accordingly, RF transmitter 110 could be held in position in any convenient manner so that it travels with the container at all times. Transmitter 110 is of a type known in the art, such as those referred to as "presence detection" and "RF tags with proximity" that detect location and piece count. These devices each generate a signal of a unique identifier that identifies the particular container 10 containing that particular transmitter 110. Thus, a code for transmitter 110 provides a tracking identifier code that is broadcast and that may be picked up by a suitably tuned receiver in a localized area.

To this end, and as shown in FIG. 18, it is preferred that RF tag 110 be a "WhereTag II" available from WhereNet USA located in Santa Clara, Calif. The WhereTag II is a component of a WhereNet Real Time Locating System (RTLS) and is an "active" tag which periodically broadcasts, via radio, its unique identification number. The tag's beacon signal can be configured to "blink" within a range from every five seconds to once an hour. Further, the WhereTag II transmits its unique 32 bit identification number via radio during each blink and provides the capability of being pre-programmed with 12 bytes of supplementary data that can be included with each blink. Accordingly, a carrier may employ receivers, as part of the WhereNets RTLS infrastructure to detect the tag's signal and precisely locate the tag and, accordingly, its associated container. For example, a proximity communication device, such as the WherePort also available from WhereNet, may be used to trigger the RF tag 110 to cause it to transmit an alternate "blink" when the tag passes through the WherePort's field. In addition, a hand-held computer, such as the WhereWand can be used to both wirelessly configure the RF tag 110 and scan the tag as desired.

Figure 19:
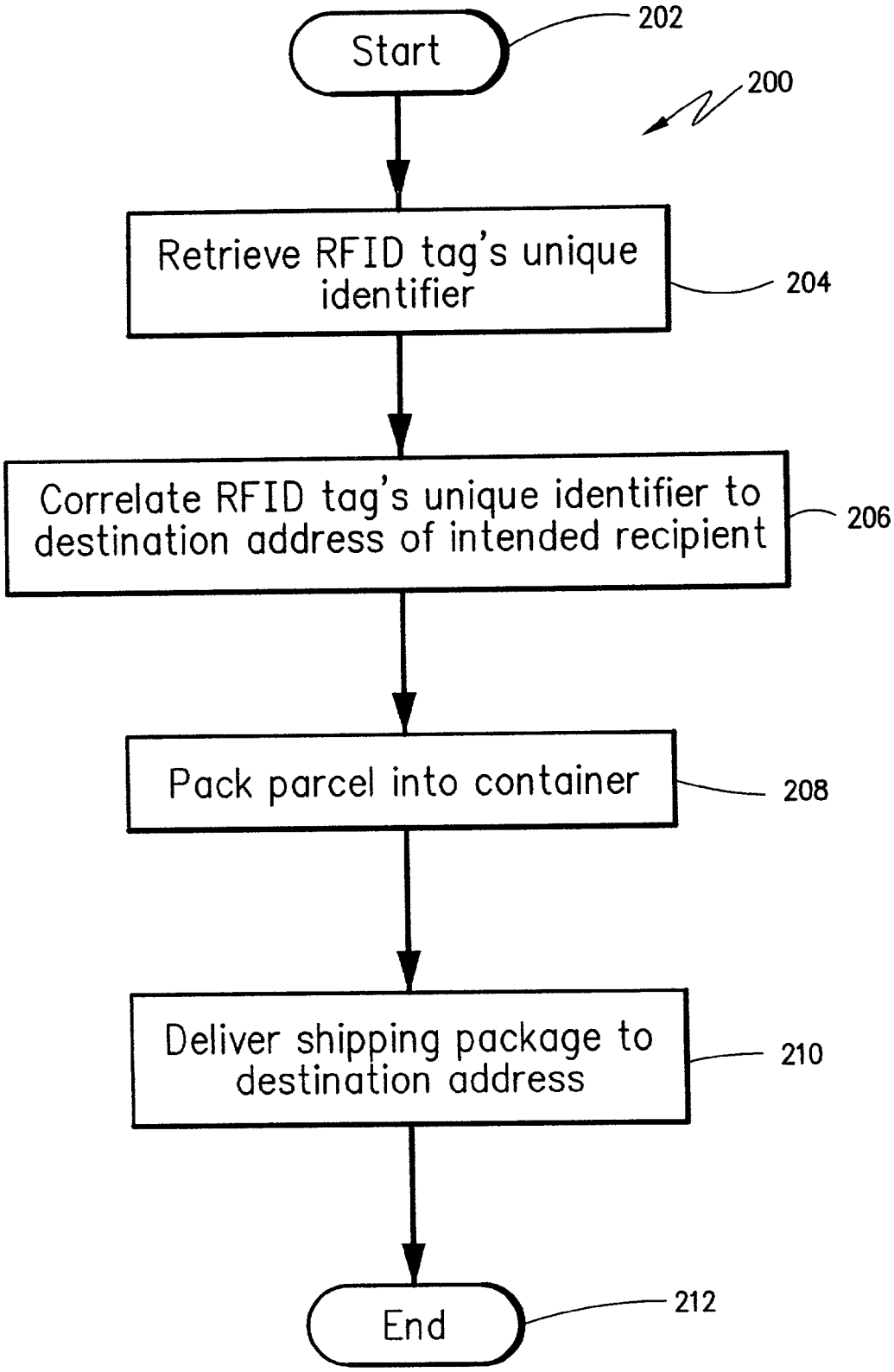
FIG. 19 is a flow chart illustrating the general concepts of the methodology according to the present invention.

With the above in mind, then, it should be appreciated that the present invention also entails a methodology for shipping a parcel, having an appropriate RF transmitter embedded therein, from a shipper to an intended recipient. It should be appreciated that the container which may be employed to accomplish such a methodology can be in any of its modular forms as discussed herein, provided it at least incorporates the RF signal transmitter. A generalized diagram showing the method 200 according to the present invention is depicted in the flowchart of FIG. 19. Following start at 202, methodology 200 proceeds to step 204 whereby a shipper retrieves the unique identifier for the RFID tag housed within the container. This unique identifier is then correlated to the destination address of the intended recipient at step 206, and the parcel to be shipped is packed into the container at step 208. Of course, it should be appreciated that packing the parcel into the container could occur before or after retrieval and correlation of the RFID tag's unique identifier. In any event, once the container is prepared, the delivered package is shipped to the destination address at step 210 and the methodology thereafter ends at step 212.

Figure 20A:
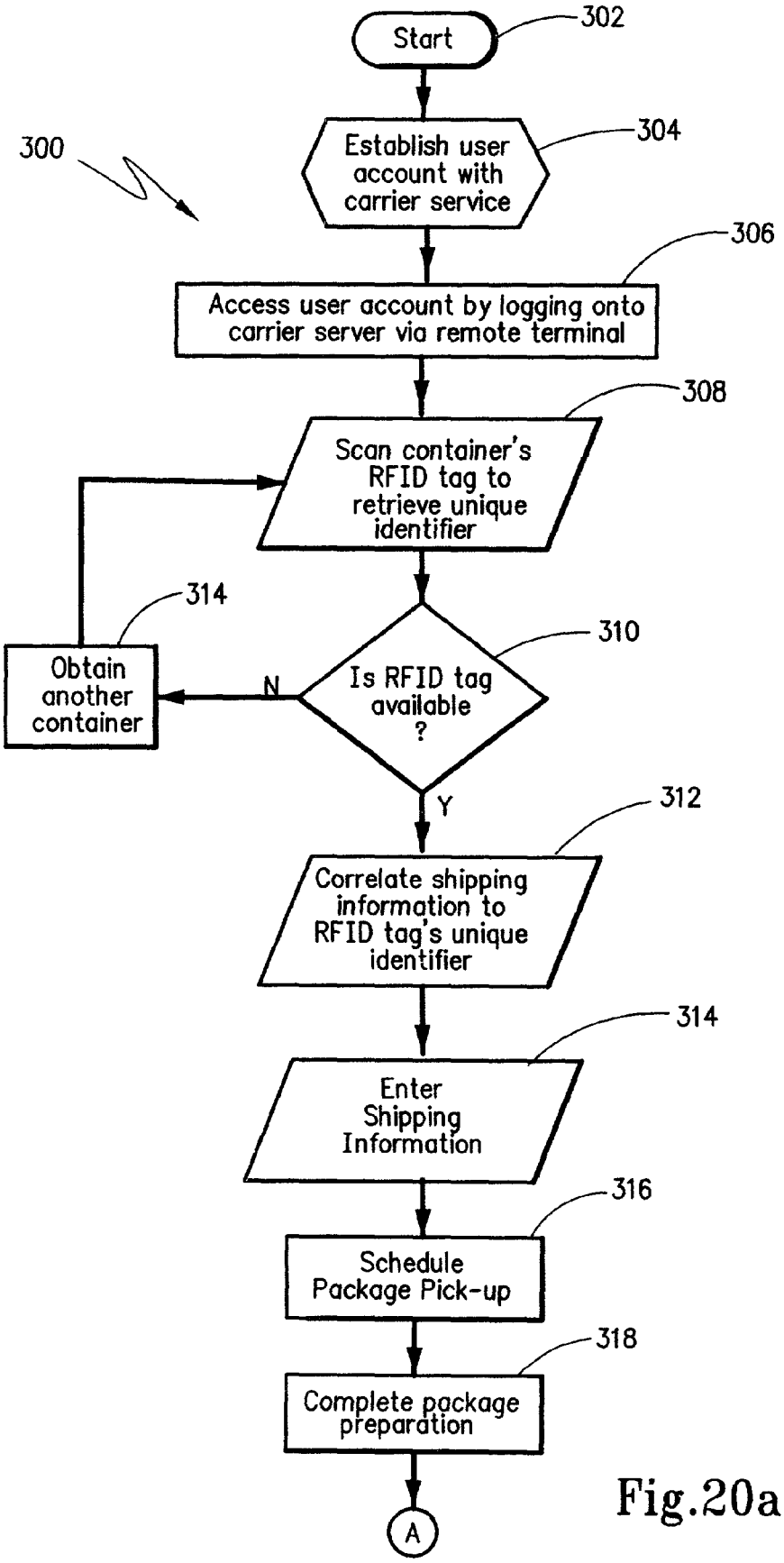
FIGS. 20(*a*) and 20(*b*) are both portions of the same flow chart to illustrate, in somewhat greater detail, the principal concepts of the methodology according to the present invention.
Figure 20B:
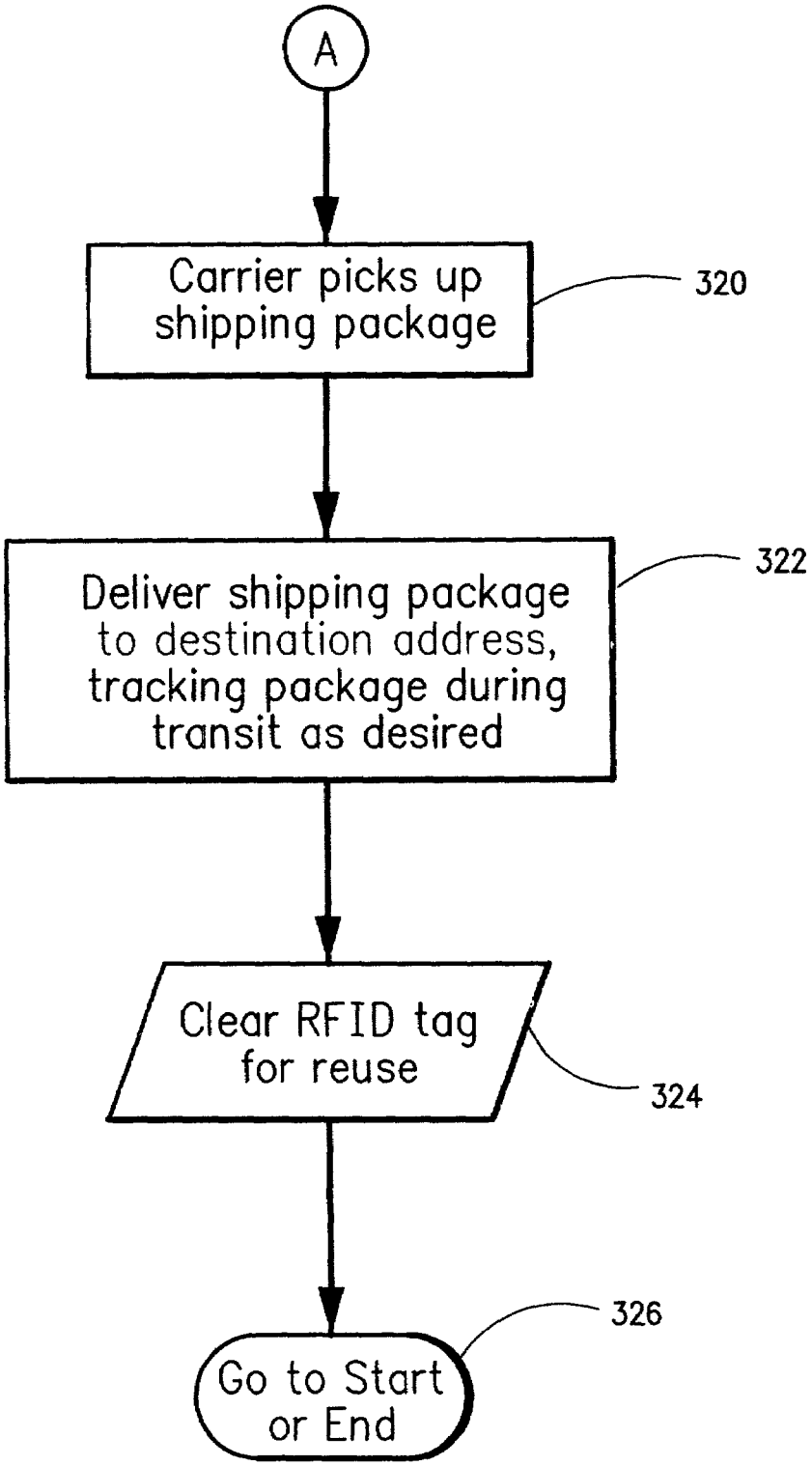

A more detailed rendition to illustrate the exemplary concepts of the methodology of the present invention is best appreciated with reference now to the flowchart of FIGS. 20(*a*) and 20(*b*). This more detailed methodology permits a shipper, such as a corporation, to set up a service with an appropriate courier for the shipment of parcels which utilize containers having embedded, active RF tags. To provide an efficient shipping system, it is contemplated that the shipping company, or other type of shipper, have an appropriate computer system which is operative to establish a communication's interface, such as through a web interface or the like, with a server computer system owned by the courier service. Preferably also, the shipper corporation sets up a secure account with the courier, through password protection or the like, via which the shipping logistics can be arranged.

Accordingly, methodology 300 starts at 302 and contemplates at step 304 that a user account has been pre-established with the courier service. Assuming the corporate shipper wishes to arrange for shipment of a container having a packaged parcel, the corporate user accesses his account by logging onto the courier's server via a remote computer terminal, presumably located at the shipper's origin location. Methodology 300 proceeds at step 308 whereby the shipper scans the container's RFID tag to retrieve its unique identifier. This can be accomplished using the WhereWand discussed above. The retrieved identification number is unique to the RFID tag housed within the shipping container and essentially serves as a "license plate number" which uniquely identifies this tag. Presumably, this RFID tag and its associated shipping container is one of a plurality of tags and associated containers which the courier either purchases or leases from a company, such as WhereNet for use with it's courier services. Accordingly, for a price, the courier would permit the corporate shipper and no other customers to use these particular tags and their associated containers which can provide added security and peace of mind to the corporate shipper.

In any event, assuming the particular RFID tag embedded in the container to be shipped is available, the response to inquiry 310 returns a "yes" and methodology 300 proceeds to step 312 whereby shipping information is correlated to the RFID tag's unique identifier. If, however, it is determined that the particular RFID tag is not available, thus indicating battery life trouble with the tag or that a previous shipment had not been closed, or other problem, the inquiry at 310 will return a "no" and the shipper can proceed to obtain another container having an associated tag and scan it's tag.

Since the corporate user has an account established with the courier, it is contemplated that the WhereWand for scanning the RFID tags can be either directly or remotely linked to the corporate shipper's computer system so that the tag's unique identification number can be interfaced with appropriate software programming loaded onto the corporate shipper's computer system. For example, once the corporate shipper logs on to his/her account, a graphical user interface (GUI) screen might appear whereby the corporate shipper inputs, either manually or directly via the WhereWand, the unique identifier for the RFID tag of interest. Assuming the RFID tag is available, then, the pre-installed software will proceed to allow the corporate shipper to input appropriate shipping information, thus accomplishing methodology step 312 in FIG. 20(*a*).

It should be appreciate then that using the internet as a gateway for the shipper to enter all shipping information in steps 312 and 314 can be very useful and provide a secure method for shipping containers. Detailed information on the shipper, the recipient and the contents can be made in required fields displayed on the corporate shipper's computer system. Further, the computer IP address and e-mail address can also be extremely important information, especially when a package recipient wants to know from whom the package originated. This is particularly useful in a corporate environment, as well as in the overall security of sending/receiving packages in general. Once the appropriate shipping information has been entered, it is necessarily correlated to the unique identifier associated with the RFID tag and no other tag, and it will remain cross-referenced to the tag for the duration of the shipment.

Through the loaded software program on the shipper's computer system and the interface with the courier's server, a prompt can be issued to the courier service to schedule package pick-up once all the appropriate shipping information has been completed. This prompt occurs at step 316 in FIG. 20(*a*). Thereafter, or at any other appropriate time before package pick-up, preparation of the package to be shipped is completed at step 318. This would entail, for example, placing the container in one of its modular configurations as discussed hereinabove and securely sealing the parcel therein. It should be understood, also, that the methodology steps generally depicted in the flowchart portion of FIG. 20(*a*) might necessarily occur at the shipper's origin location. Further, although not necessary, if desired the shipper can also place an appropriate address label on the container by including handwritten, printed, or bar code shipping information as discussed above. This can serve as a precautionary measure in the event the embedded RFID tag fails or otherwise becomes inoperable during transit. However, since the RFID tag of choice can be pre-programmed with 12 bytes of supplementary data, in addition to its embedded unique identification number, the appropriate shipping information could all be programmed into the tag via the software interface with the shipper's computer system so that this information is not discernable unless appropriately retrieved via a WhereWand or a WherePort device.

Methodology 300 then proceeds to step 320 in FIG. 20(*b*) whereby the courier picks up the shipping package, as well as any other packages prepared for shipment according to the process discussed above. Using WhereNet's WherePort technology, the courier can quickly and accurately identify all packages which need to be sent without the need to individually handle and scan every package. Instead, using the RF technology discussed herein, the WherePort scanner can proximity count all packages that are ready for shipment at one time. Further if it is necessary to identify a single individual package among a group of packages, then the WherePort can send the RF tags a signal which will "energize" the tags, initiating a sound or vibration to distinguish the individual package.

In any event, at step 322 the shipping package(s) is delivered to the destination address of the intended recipient, and the courier may employ appropriate tracking as desired utilizing WhereNet's real time locating system (RTLS) infrastructure as discussed above. The courier will handle the individual packages as they would any other package in today's network, with the improved handling efficiency that can be integrated utilizing the active RF technology in lieu of passive bar code technology. Tracking can, thus, be accomplished by the courier using checkpoint scanning at various locations along the route to the intended recipient. Alternatively, since the container of the present invention can be readily adapted for use with the somewhat larger beeper size tags which permit GPS tracking capabilities, shippers and couriers employing such tags could track parcels utilizing know GPS tracking techniques all the way through the delivery process to the intended recipient(s).

Once the package has been delivered to the intended recipient, the courier's delivery driver will close out the data information on the embedded RFID tag utilizing a hand-held computer, such as the WhereWand, and this clearing information can be sent wirelessly to the courier server's database. The close out information will include a prompt to clear the RFID tag for reuse at 324 so that the shipping process can begin again or end at step 326.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A container adapted to receive a parcel for shipment to an intended recipient, comprising:

(1) a pouch having a pouch interior and a mouth communicating with the interior, said pouch has a perimeter and includes first and second flexible body panels joined about a majority of the perimeter to define a sealed edge with an unjoined portion defining the mouth;

(2) an interlocking closure movable between i. an open position such that the parcel may be inserted into and removed from the interior, and ii. a closed position to retain the parcel in the interior as a received parcel; and (3) a protective insert structure removably disposed in the interior of said pouch, said protective insert structure having an insert interior adapted to substantially envelop the parcel to reduce risk of damage to the parcel during shipment, said protective insert structure including an inflatable bladder which substantially envelops the parcel and a puncture resistant lining interposed between said inflatable bladder and said first and second flexible body panels, such that said puncture resistant lining is disposed in the pouch interior in facing relationship to said pouch and said inflatable bladder is disposed interiorly of said puncture resistant lining.

2. A container according to claim 1 including (1) a removable label including i. a strip constructed of a selected strip material and having an area adapted to receive information corresponding to an address of an intended recipient of the received parcel, ii. a layer of a selected adhesive; and (2) a label panel secured to said container body, said label panel including an exposed surface portion formed of a material iii. to which the selected adhesive will adhere sufficiently to retain the label on the container body during shipment yet iv. from which the label may be forcefully removed without tearing the strip material.

3. A container according to claim 1 including (1) a locking structure, and (2) a locking member operative to engage said locking structure and movable into a locked state thereby to secure the closure in the closed position.

4. A container according to claim 1 wherein said closure is a zipper having a pull tab.

5. A container according to claim 4 including (1) a first grommet disposed on said first body panel and (2) a second grommet disposed on said second body panel, each of said first and second grommets located proximately to said pull tab when said zipper is closed thereby to define a locking structure, and including a locking member operative to engage said first and second grommets and said pull tab thereby to secure the zipper in the closed position.

6. A container according to claim 5 wherein said locking member includes a cable tie.

7. A container according to claim 1 including an active radio frequency (RF) signal transmitter supported within said pouch.

8. A container for items, comprising:

(1) a pouch having an interior and a mouth communicating with the interior;

(2) a closure movable between i. an open position such that items may be inserted into and removed from the interior, and ii. a closed position to retain the items in the interior as received items; and (3) an air bladder disposed in the interior of said pouch for receiving and substantially enveloping the items to reduce damage thereto during shipment, said air bladder formed as a flexible bag having first and second bag panels joined about a portion of its perimeter to define a sealed edge with an unjoined portion defining a bladder mouth communicating with a bladder interior, each of said first and second bag panels formed as a multi-layered plastic construction to include a matrix of cells that are selectively inflatable and deflatable.

9. A container according to claim 8 wherein said air bladder is insertable into the interior of said pouch through said mouth.

10. A container according to claim 8 including (1) a removable label including i. a strip constructed of a selected strip material and having an area adapted to receive information corresponding to an address of an intended recipient of the received parcel, ii. a layer of a selected adhesive; and (2) a label panel secured to said pouch, said label panel including an exposed surface portion formed of a material i. to which the selected adhesive will adhere sufficiently to retain the label on the pouch during shipment yet ii. from which the label may be forcefully removed without tearing the strip material.

11. A container according to claim 8 including (1) a locking structure, and (2) a locking member operative to engage said locking structure and movable into a locked state thereby to secure the closure in the closed position.

12. A container according to claim 8 wherein said pouch is a flexible, has a perimeter, and includes first and second body panels joined about a majority of the perimeter to define a sealed edge with an unjoined portion defining the mouth.

13. A container according to claim 12 wherein said closure is a zipper having a pull tab.

14. A container according to claim 13 including (1) a first grommet disposed on said first body panel and (2) a second grommet disposed on said second body panel, each of said first and second grommets located proximately to said pull tab when said zipper is closed thereby to define a locking structure and including a locking member operative to engage said first and second grommets and said pull tab thereby to secure the zipper in the closed position.

15. A container according to claim 14 wherein said locking member includes a cable tie.

16. A container according to claim 12 wherein each of said first and second body panels is formed with a multi-layered construction.

17. A container according to claim 8 including an active radio frequency (RF) signal transmitter housed within said pouch.

18. A container adapted to receive a parcel for shipment to an intended recipient, comprising:

(1) a flexible pouch having an interior and including i. first and second flexible body panels joined about a majority of a perimeter of said pouch to define a sealed edge with an unjoined portion defining a mouth communicating with the interior;

(2) an interlocking closure movable between i. an open position such that a parcel may be inserted into and removed from the interior and ii. a closed position to retain the parcel in the interior as a received parcel; and (3) a bladder and puncture resistant lining, said lining disposed in the interior of said flexible pouch between said bladder and said body panels, said lining adapted to substantially envelop the parcel to reduce damage thereto during shipment, said puncture resistant lining including first and second geometrically congruent panel sections releasably secured together along three edges to define an opening which communicates with said mouth, and wherein said first and second panels sections are secured to said first and second flexible body panels, respectively.

19. A container according to claim 18 wherein said puncture resistant lining is formed from a stiff yet flexible material.

20. A container according to claim 19 wherein said material is selected from a group consisting of semi-rigid plastic, Kevlar and puncture-resistant fabrics.

21. A container according to claim 18 wherein said first and second panel sections are releasably secured to said first and second flexible body panels, respectively.

22. A container according to claim 21 including at least one fastening structure for releasably securing said first panel section to said first flexible body panel and said second panel section to said second flexible body panel.

23. A container according to claim 22 wherein said fastening structure includes cooperative hook and loop fastening elements disposed, respectively, on said puncture resistant lining and said pouch.

24. A container according to claim 18 wherein said first and second panel sections are joined together at a transversely extending crease.

25. A container according to claim 18 including (1) a removable label including i. a strip constructed of a selected strip material and having an area adapted to receive information corresponding to an address of an intended recipient of the received parcel, ii. a layer of a selected adhesive; and (2) a label panel secured to said container body, said label panel including an exposed surface portion formed of a material i. to which the selected adhesive will adhere sufficiently to retain the label on the container body during shipment yet ii. from which the label may be forcefully removed without tearing the strip material.

26. A container according to claim 18 including (1) a locking structure, and (2) a locking member operative to engage said locking structure and movable into a locked state thereby to secure the closure in the closed position.

27. A container according to claim 18 wherein said closure is a zipper having a pull tab.

28. A container according to claim 27 including (1) a first grommet disposed on said first body panel and (2) a second grommet disposed on said second body panel, each of said first and second grommets located proximately to said pull tab when said zipper is closed thereby to define a locking structure and including a locking member operative to engage said first and second grommets and said pull tab thereby to secure the zipper in the closed position.

29. A container according to claim 28 wherein said locking member includes a cable tie.

30. A container according to claim 18 wherein each of said first and second body panels is formed with a multi-layered construction.

31. A container according to claim 18 including a signal transmitter housed within said flexible pouch.

* * * * *